US011874097B1

(12) United States Patent
Aerni

(10) Patent No.: US 11,874,097 B1
(45) **Date of Patent: *Jan. 16, 2024**

(54) AMMUNITION RELOADING DEVICE

(71) Applicant: Wilbur Manufacturing Inc., Las Vegas, NV (US)

(72) Inventor: William H. Aerni, Hayward, CA (US)

(73) Assignee: Wilbur Manufacturing Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/448,992

(22) Filed: Sep. 27, 2021

Related U.S. Application Data

(63) Continuation of application No. 17/007,562, filed on Aug. 31, 2020, now Pat. No. 11,131,531, which is a continuation of application No. 16/282,001, filed on Feb. 21, 2019, now Pat. No. 10,794,676.

(51) Int. Cl.
*F42B 33/10* (2006.01)

(52) U.S. Cl.
CPC ..... *F42B 33/10* (2013.01)

(58) Field of Classification Search
CPC ..... F42B 33/005; F42B 33/04; F42B 33/10
See application file for complete search history.

(56) References Cited

U.S. PATENT DOCUMENTS 2,719,453 A * 10/1955 Bahler ..... F42B 33/005 86/43
4,862,567 A * 9/1989 Beebe ..... F42B 33/005 86/43
5,649,465 A * 7/1997 Beebe ..... F42B 33/10 86/24
6,244,154 B1 6/2001 Beebe et al.
7,703,369 B1 4/2010 Lee
9,267,775 B1 * 2/2016 Kleinschmit ..... F42B 33/001
10,794,676 B1 10/2020 Aerni
11,204,226 B1 * 12/2021 Lee ..... F42B 33/001

FOREIGN PATENT DOCUMENTS

DE 563930 C 11/1932

OTHER PUBLICATIONS

Forster Products; Bench Rest Seater Dies; Reloading & Gunsmithing Tools Straight Shooters; Catalog #81; 2 pages, 2008.

(Continued)

*Primary Examiner* — J. Woodrow Eldred
(74) *Attorney, Agent, or Firm* — Stetina Brunda Garred & Brucker

(57) ABSTRACT

An ammunition cartridge case reloading die has a die body defined by an interior bore and a bore opening, and a retention cap attachable to the die body. A cartridge case tool is fixed to the retention cap in axial alignment with the interior bore, and a tip of the cartridge case tool is at a proscribed distance relative to the bore opening. A centering shuttle is in sliding engagement in the interior bore of the die body, and defines a shuttle bore through which the cartridge case tool passes, and a reverse taper opening receptive to the cartridge case. The die may has a biasing element disposed within the interior bore between the centering shuttle and the retention cap, with movement of the centering shuttle within interior bore of the die body being dampened by the biasing element.

20 Claims, 3 Drawing Sheets

(56) References Cited

OTHER PUBLICATIONS

Hornady Manufacturing Co.; 2-Die Set; Hornady 1990 Catalog; 2 pages; 1990.
RCBS; Reloading, Case Forming & Custom Dies; RCBS 1984 Catalog, 2 pages; 1984.
RCBS; RCBS Gold Medal Match Series Dies; RCBS 2007 Catalog; 2 pages; 2007.
RCBS; MatchMaster; https://www.rcbs.com/dies-and-shell-holders/matchmaster-1/matchmaster-%E2%80%93-seater-die/1000999.html; 6 pages; Webpage creation date: Sep. 2021; Webpage access date: Aug. 31, 2023.
Vickerman Bullet Seaters, Handloader's Digest; 1964; 3 pages.
Vickerman Inline Micrometer Dies; Buffalo Arms; www.buffaloarms.com/vickerman-micrometer-dies-gmwvmd.html; 2021 (webpage accessed Sep. 14, 2023); 4 pages.

* cited by examiner

AMMUNITION RELOADING DEVICE

CROSS-REFERENCE TO RELATED APPLICATIONS

The present application is a continuation of U.S. patent application Ser. No. 17/007,562, filed Aug. 31, 2020 and issued as U.S. Pat. No. 11,131,531, which is a continuation of U.S. patent application Ser. No. 16/282,001, filed on Feb. 21, 2019 and issued as U.S. Pat. No. 10,794,676, the entire content of each if which are wholly incorporated by reference herein.

STATEMENT RE: FEDERALLY SPONSORED RESEARCH/DEVELOPMENT

Not Applicable

BACKGROUND

1. Technical Field

The present disclosure relates generally to reloading ammunition, and more particularly to dies for decapping and swaging cartridge cases of spent ammunition cartridges to prepare the cartridge for further processing.

2. Related Art

In its most fundamental form, a firearm is device configured to launch a projectile from a barrel with a propellant. The pressure from the rapidly expanding gasses of the ignited propellant is partially contained within the barrel and directed to the projectile that is positioned at the barrel breech, propelling it toward the muzzle and beyond. Over the course of history, there have been numerous advancements to increase accuracy, rate of fire, longevity, and safety of firearms while still applying these operational principles.

Earlier forms of firearms such as muzzleloaders could be prepared for firing by the manual placement of propellant, e.g., black powder, for the muzzle end of the barrel, followed by the projectile. Modern firearms utilize a self-contained cartridge that is comprised of the same basic components of the projectile/bullet and propellant, but with the propellant being disposed within the interior of a metallic cartridge case, and the bullet being seated on the case mouth. Conventional ammunition cartridges utilize smokeless gunpowder, and ignition thereof is achieved with an explosive primer that is positioned at the case head. In use, the cartridge is fed into a chamber defined in the barrel toward the breech end, and locked into place by way of the firearm action. A firing pin or a striker is driven against the explosive, which momentarily explodes, causing the main propellant to ignite. The expanding gasses of the ignited propellant are contained within the chamber and directed to the projectile that is retained within the case mouth, and launching it down the barrel. After firing, the cartridge case is removed from the chamber by an extractor, and ejected from the firearm. In repeating actions, a fresh cartridge can be loaded and the process repeated.

The case is typically constructed of brass, though softer steel alloys may also be used. Brass is preferable for its malleability/expandability to safely contain the pressures of the ignited powder, as well as its structural rigidity that helps maintain the integrity of the cartridge during rough handling and loading into the firearm before use. One of the most expensive components of an ammunition cartridge is the cartridge case and is also the most readily retrievable; the bullet is far separated from the firearm after being launched, the powder has been burnt, and the primer has been spent and its rear face has been deformed by the striker/firing pin. Although the rapid expansion and contraction of the case walls also causes deformations, with appropriate processing, the case can be reused.

With the rising cost of ammunition, it is common for active participants in the shooting sports to reload ammunition. Additionally, by handloading ammunition, the reloader can exercise a greater degree of control over the final cartridge in terms of case dimensions, powder charge weights, primer placement, and crimping compared to mass-manufactured ammunition. Thus, a greater degree of accuracy and consistency in the ballistic performance can be achieved. Furthermore, with different types and charge weights of powder being selectable by the reloader, a cartridge can be tuned for optimal performance in a particular firearm.

Reloading a spent cartridge involves several steps. First, the cartridge case, which has expanded and slightly contracted after being fired, is resized to standard dimensions. Such resizing step may also including case length trimming, which is typically necessary with bottlenecked rifle cartridges. The cartridge is forced into a resizing die with internal dimensions that correspond to the standard. Simultaneously, or as a separate step, the case may be de-primed—that is, the struck primer is removed from the cartridge case in the case head. Thereafter, the exterior and interior surfaces of the case may be cleaned by mechanical tumbling or with an ultrasonic bath. The case mouth is then expanded with an expansion die, and a new primer is seated. Bottlenecked rifle cartridges further require a case neck resizing step. A measured charge of powder is placed into the case, and the bullet is placed on to the case mouth, where it is loosely held. Another die, referred to as a seating die, presses the bullet into the case mouth to a prescribed depth, to conform the overall length to the aforementioned standard. Depending on the ammunition type, a crimp may be applied to the case mouth to ensure retention of the bullet therein.

Reloaders typically utilize a reloading press for the foregoing cartridge preparation and reloading steps. A movable ram holds the case by the rim, and raised to a stationary die that is positioned at a prescribed distance relative to the end of the ram. The simplest form is a single stage press, where the die is replaced for each step, and multiple cases under go the step(s) that is possible with a single die. Turret presses are also known in the art, where multiple dies corresponding to each of the case processing/reloading steps are installed onto a rotating turret, each at the required or proscribed depths. Cases may still be processed in batches, but the time-consuming removal and tuning of each of the dies is not necessary, as the turret may simply be rotated to the next station. There are also progressive presses, where a single press stroke is operative to apply multiple processing/reloading steps to a sequenced set of cases, that is, the case is progressively moved to each station or die. Thus, a first case may be undergoing an expansion step while a second case may be undergoing to resizing/decapping step, and so on.

Changing dies from step to step takes a significant amount of time, and so it is desirable to minimize the number of die changes needed. However, there is a significant compromise with dies that attempt to combine multiple processing steps, as any given step of a combined die may be inadequate with respect to the quality of the result achievable with a single, dedicated die. A progressive press diminishes such issues, as a larger toolholder may accommodate a large number of pre-installed dies, and thus more specialized, single-purpose dies may be utilized without the countervailing deficiency of multiple and repeated die changes.

The decapping step is challenging, particularly with bottlenecked cartridges. A typical die incorporates a long, thin shaft referred to as a decapping pin that is threadably attached to the interior extent of the die. The decapping pin must be long enough that when the press ram fully inserts the cartridge into the die, it extends beyond the cartridge case opening. The thickness of the decapping pin, as well as the die attachment may be limited in dies for bottlenecked cartridges that have a narrower opening. The pin and its base must fit within the narrower case mouth. To the extent the case, as positioned on the ram, is misaligned with the decapping pin, the case mouth may be crushed as the case is moved into the die. Additionally, the decapping pin may also make contact with the case, which can lead to breakage of the pin and/or damage to the case. Similar issues exist with cartridge case swaging dies, which remove any present crimp that assisted in holding the previous primer in place, and make the primer pocket uniform.

Accordingly, there is a need in the art for an improved reloading die that properly aligns the cartridge case with the die, particularly its decapping pin or swager foot tools, before making contact therewith. There is also a need in the art for decapping die that reduces the possibility of crushing the case mouths, as well as reducing decapping pin breakage.

BRIEF SUMMARY

An embodiment of the present disclosure is directed to an ammunition cartridge case reloading die. The die may include a die body defined by an interior bore and a bore opening, as well as a retention cap attachable to the die body. There may also be a cartridge case tool that is fixed to the retention cap in axial alignment with the interior bore. A tip of the cartridge case tool may be at a proscribed distance relative to the bore opening. The die may also include a centering shuttle in sliding engagement in the interior bore of the die body. The centering shuttle may define a shuttle bore through which the cartridge case tool passes, along with a reverse taper opening receptive to the cartridge case. The die may further include a biasing element disposed within the interior bore between the centering shuttle and the retention cap. Movement of the centering shuttle within interior bore of the die body may be dampened by the biasing element.

Another embodiment of the present disclosure contemplates a die for reloading an ammunition cartridge case. The die may include a hollow die body with an open end receptive to the ammunition cartridge case. Additionally, the die may include a cartridge case tool centrally fixed relative to the die body. A tip of the cartridge case tool may be positioned at a predefined distance to the open end of the die body. There may also be a sliding shuttle within the hollow body die that is in receptive engagement with the cartridge case tool. The die may further include a biasing spring in the hollow body die and against the sliding shuttle. Movement of sliding shuttle in the hollow body die may be dampened by the biasing spring.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of the several presently contemplated embodiments of an ammunition cartridge case reloading die. This description is not intended to represent the only form in which the embodiments of the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second, front and rear, left and right, distal and proximal and the like are used solely to distinguish one from another entity without necessarily requiring or implying any actual such relationship or order between such entities.

Figure 1:
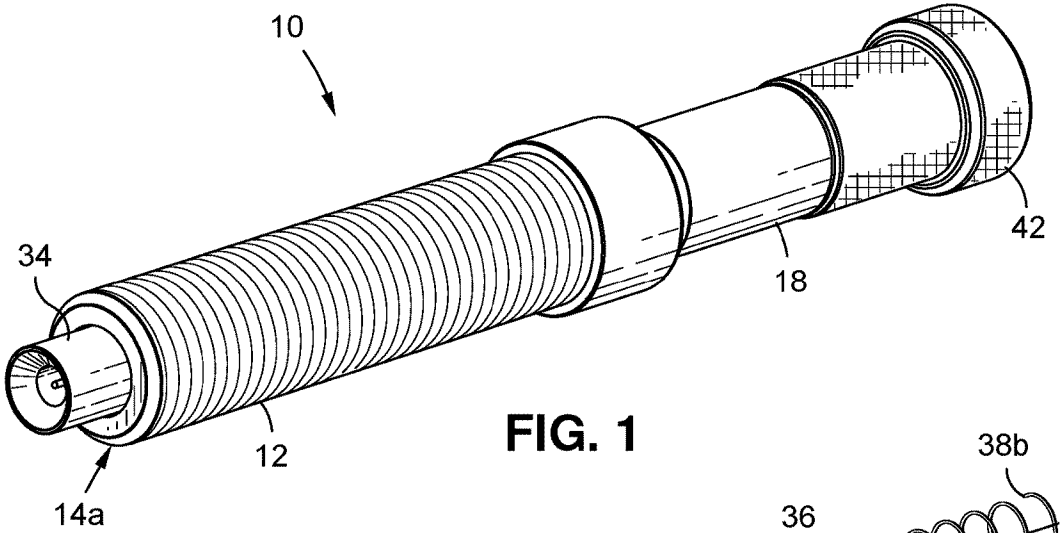
FIG. 1 is a perspective view of an embodiment of an ammunition cartridge case reloading die.
Figure 2:
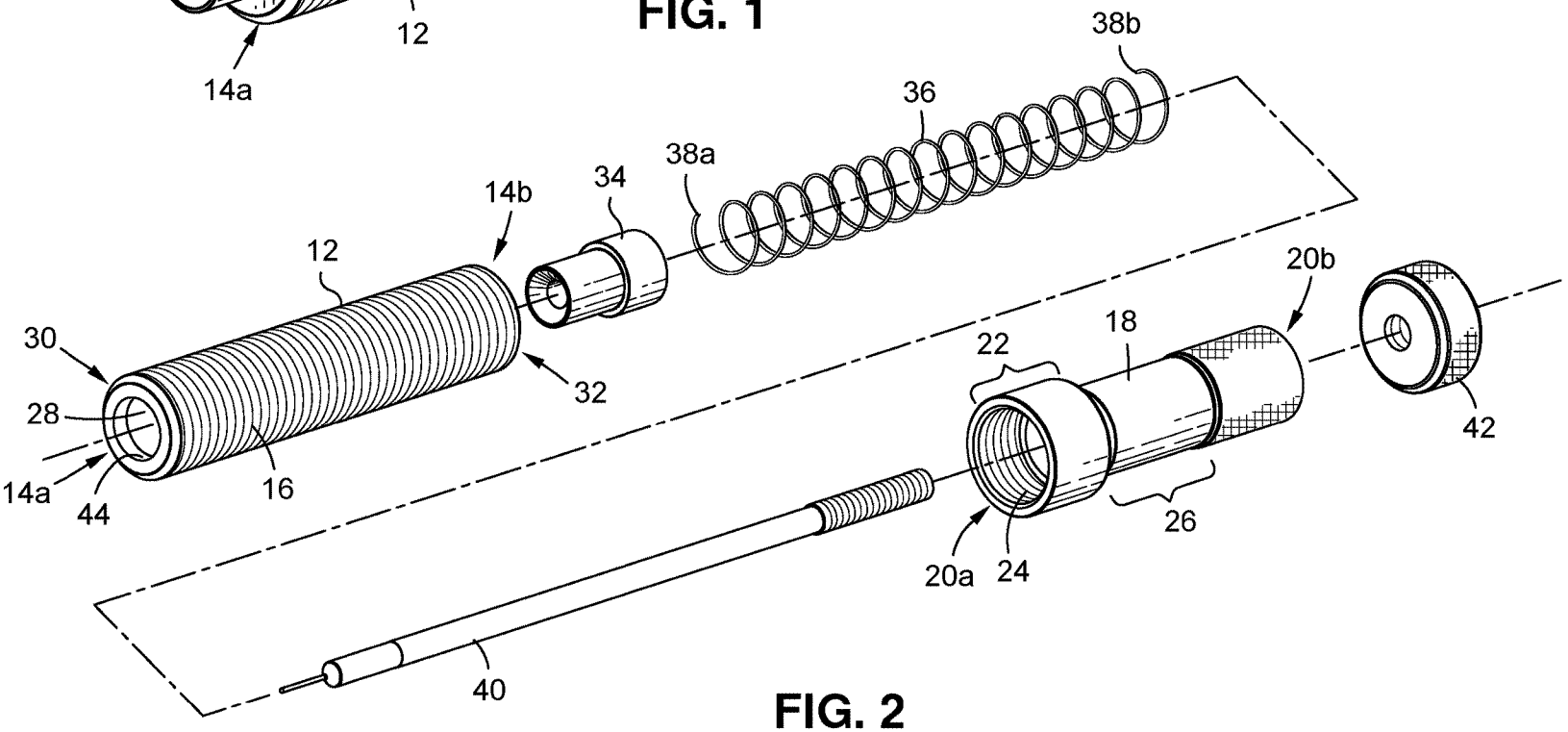
FIG. 2 is an exploded perspective view of the ammunition cartridge case reloading die shown in FIG. 1.

Referring now to FIGS. 1 and 2, various embodiments of the present disclosure are directed to an ammunition cartridge case reloading die 10, which may be referenced simply as the reloading die. In the illustrated embodiment, the reloading die 10 is a dedicated decapping die, that is, its sole function is to remove the primer from a fired or spent ammunition cartridge. This is by way of example only and not of limitation, however, and it is expressly contemplated that the reloading die 10 may incorporate additional features encompassing other cartridge case processing steps without departing from the scope of the present disclosure. Furthermore, the features of the reloading die 10 disclosed herein may be adapted to other dies beyond the illustrated decapping and swaging dies. Those having ordinary skill in the art will recognize the modifications for making such adaptations, and thus such modifications are deemed to be within the scope of the present disclosure.

The reloading die 10 is generally comprised of a die body 12 with a first open end 14*a* and an opposed second open end 14*b*. A substantial entirety of the external portion of the die body 12 is threaded, that is, defines a continuous threading 16. Conventional reloading machines incorporate toolholders with a standard ⅞"-14 thread pitch, so the threading 16 of the embodiments of the reloading die 10 are the same to ensure compatibility therewith. Other threading pitches may be necessary for dies used to reload larger ammunition calibers such as 0.50 BMG (Browning Machine Gun) cartridge cases, in which case the threading 16 may be modified accordingly. The mounting depth of the reloading die 10 in the reloading press toolholder relative to the maximum extension of the press ram with a shell holder attached thereto can vary from die to die and is therefore understood to be individually set. In order to maintain such position, there may be a locking nut (not shown) also threaded on to the die body 12, and after the desired mounting depth is achieved, such locking nut may be tightened against the toolholder.

Threaded on or otherwise attached to the opposite second open end 14*b* of the die body 12 is a retention cap 18 that is defined by a first open end 20*a* and opposed partially closed end 20*b*. In an exemplary embodiment, the retention cap 18 includes a body coupling portion 22 with interior threading 24 that matches the pitch of the threading 16 on the die body 12. Furthermore, the retention cap 18 may include a central body 26 with a narrower diameter than that of the body coupling portion 22. Additional structural details of the retention cap 18 will be considered more fully below.

Figure 3:
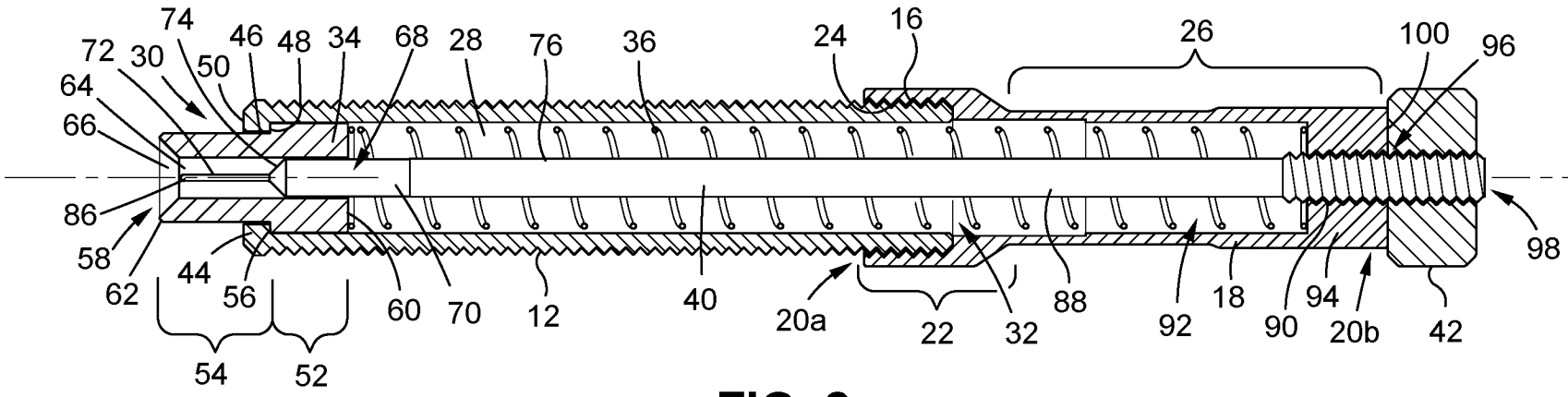
FIG. 3 is a cross-sectional view of one embodiment of the present disclosure configured as a decapping die.

With additional reference to the cross-sectional diagram of FIG. 3, the die body 12 defines an interior bore 28 with a first bore opening 30 and an opposed second bore opening 32. Enclosed within the die body 12 and the retention cap 18 is a centering shuttle 34, which is in sliding engagement with the interior bore 28. A biasing element 36, e.g., a coil spring, is also enclosed within the die body 12 and the retention cap 18. The biasing element 36 is accordingly defined by a shuttle end 38*a* and opposed retention cap end 38*b*. It is understood that the biasing element 36 exerts force against the centering shuttle 34, pushing the same towards the first bore opening 30 as particularly shown in FIG. 3. A portion of the centering shuttle 34 may project from the interior bore 28.

Fixed to the retention cap 18 and in central axial alignment therewith is a cartridge case tool 40. In an exemplary embodiment, the cartridge case tool 40 is threaded on to the retention cap 18 and secured from the opposing side with a tool locking nut 42. With the cartridge case tool 40 being mounted to the retention cap 18 and the retention cap 18, in turn, being coupled to the die body 12, it is understood the cartridge case tool 40 is in a fixed position relative to the first bore opening 30. Likewise, the cartridge case tool 40 is understood to be in axial alignment with the interior bore 28. As will be described more fully below, a cartridge case is inserted into the interior bore 28 from the first bore opening 30, and then makes contact with the centering shuttle 34. The biasing element 36 provides a slight resistance to or dampening of the insertion of the cartridge case, with such resistance forcing a slight adjustment in the positioning of the case within the interior bore 28. This also aids in aligning the cartridge case tool 40 with the center of the cartridge, which is where the cartridge case thereof is also located.

Having considered the basic components of the reloading die 10 and its general functional inter-relationships, additional details specific to the illustrated embodiments will now be described. As indicated above, the centering shuttle 34 slides back and forth within the interior bore 28. Generally, the limit of travel of the centering shuttle 34 is the first bore opening 30. More particularly, the die body 12 includes an inner flange 44 that reduces the diameter of the first bore opening 30 relative to the remainder of the interior bore 28. The inner flange 44 is characterized by a cylindrical journal surface 46, along with an inner rim face 48 and an opposed outer lip 50 that are both substantially perpendicular to the cylindrical journal surface 46.

The centering shuttle 34, in turn, may be defined by a shuttle body 52, with the diameter thereof generally corresponding to the diameter of the interior bore 28 of the die body 12. Thus, per the reference to the sliding engagement between the centering shuttle 34 and the interior bore 28, the shuttle body 52 is understood to be slightly undersized relative to the diameter of the interior bore 28 to permit such freely sliding relationship. The interior bore 28 is thus understood to be smooth, that is, having an unrestricted surface without substantial axial projections that would restrict the centering shuttle 34 from freely sliding therein. Along these lines, the shuttle body 52 is likewise understood to define a smooth, unrestricted surface that permits such a sliding engagement in the interior bore 28.

In addition to the shuttle body 52, the centering shuttle 34 is also defined by a shuttle neck 54 with a reduced diameter compared to the shuttle body 52. The shuttle neck 54 is understood to have diameter corresponding to the first bore opening 30 such that the shuttle neck 54 is in a freely sliding engagement with the cylindrical journal surface 46. Like the interface between the interior bore 28 and the shuttle body 52, the shuttle neck 54 and the cylindrical journal surface 46 are both understood to be smooth and without restrictions that would limit such sliding engagement. Between the shuttle neck 54 and the shuttle body 52 is a shuttle shoulder 56. At the maximum extent of travel, the shuttle shoulder 56 abuts against the inner rim face 48 defined by the inner flange 44. The inner flange 44 thus blocks the centering shuttle 34 from further movement beyond the first bore opening 30, though portions of the shuttle neck 54 extend beyond the outer lip 50.

The travel path of the centering shuttle 34 into the interior bore 28 is beyond the inner rim face 48, and so the shuttle neck 54 can be disengaged from the inner flange 44. The shuttle neck 54 defines a case engagement end 58, while the shuttle body 52 defines a spring contact end 60. Upon the centering shuttle 34 returning toward the first bore opening 30, there may be a slight tilt or axial misalignment with respect to the centering shuttle 34. To avoid binding of the tip of the shuttle neck 54 against the inner rim face 48 upon returning, the case engagement end 58 may incorporate a conical taper 62.

The centering shuttle 34 is further defined by a shuttle bore 64 that extends axially therethrough. As illustrated, the cartridge case tool 40 is positioned within the shuttle bore 64, and thus the centering shuttle 34 is likewise in sliding engagement with the cartridge case tool 40. The case engagement end 58 of the centering shuttle 34 defines a reverse conical/tapered opening 66 to the shuttle bore 64. In other words, the opening 66 has a wide mouth that narrows to the shuttle bore 64. The presently disclosed reloading die 10 may be adapted for decapping bottlenecked cartridges that are defined by a case body portion and a narrower neck portion, with tapered section between the body portion and the neck portion. The reverse conical opening 66 is understood to be sized and shaped to interface with the tapered shoulder of such a bottlenecked case, while the shuttle bore 64 may be sized and configured to receive the neck portion of the same. Furthermore, the reverse conical opening 66 may help guide the narrower case mouth at the neck portion toward the shuttle bore 64, as there may be a slight axial misalignment.

According to one embodiment of the present disclosure, the cartridge case tool 40 is a decapping pin 68 that is characterized by a base portion 70 and a pin portion 72. The base portion 70 with the larger diameter is understood to provide structural rigidity and prevent breakage over numerous impact cycles, while the pin portion 72 with the reduced diameter compared to the base portion 70 is sized and shaped to pass through the cartridge case flash hole. Between the base portion 70 and the pin portion 72 there is a tapered neck portion 74 that assists with centering the case in relation to the decapping pin 68 and makes contact with the case mouth. This is also understood to prevent the binding of the cartridge case to the decapping pin 68. The shuttle bore 64 may be oversized relative to the decapping pin 68, so as to provide clearance for the case wall/neck portion when the cartridge case is fully seated within the shuttle and the cartridge case tool 40 is within the case interior to engage the primer.

Figure 4:
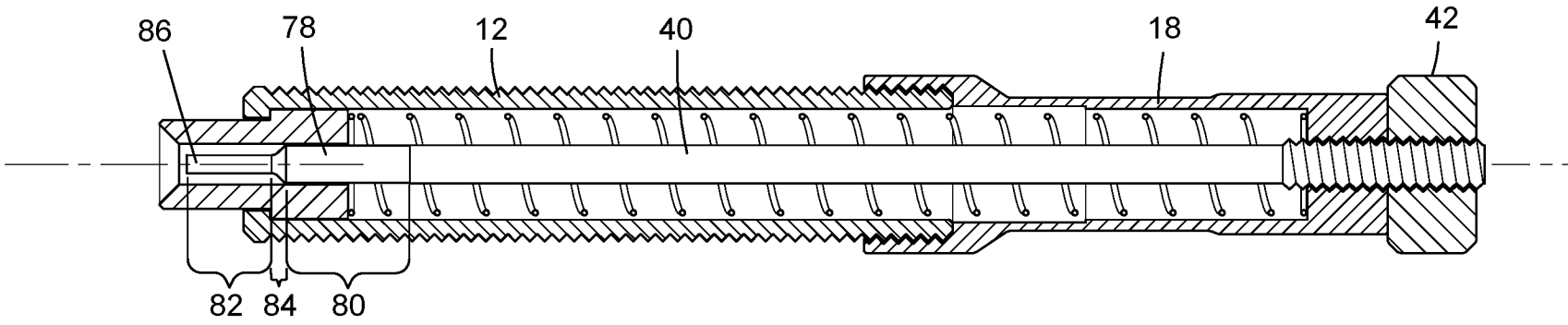
FIG. 4 is a cross-sectional view of another embodiment of the present disclosure configured as a cartridge case swaging foot.

The decapping pin 68 may be configured as a replaceable unit that is removably engageable to a ram shaft 76, which in turn is mounted to the retention cap 18 as generally described above in the context of the overall cartridge case tool 40. A variety of coupling mechanisms for the decapping pin 68/ram shaft 76, though commonly, male/female threading may be used. Alternatively, the entirety of the cartridge case tool 40, that is, the decapping pin 68 and the ram shaft 76, may be a single, unitary structure FIG. 4 illustrates another embodiment of the reloading die 10 in which the cartridge case tool 40 is a swager foot 78. As will be recognized by those having ordinary skill in the art, in some ammunition cartridges, the cartridge case is crimped around the primer to prevent dislodging during firing. Although the primer may be removable, the pre-existing crimp may obstruct a new primer from being seated. Accordingly, it may be necessary for the cartridge case to be swaged, and a swaging tool may be inserted from the case base to make the primer pocket uniform.

Because of the substantial force being applied to the case head that is transmitted through the case wall to the mouth, deformation of the case wall may be prevented with the use of the swager foot 78. Like the decapping pin 68, the swager foot 78 is inserted into the case, and presses against the inside of the case base. From opposite the swager foot 78, the primer pocket swager may be pressed into the primer pocket to remove any previous applied crimp. The swager foot 78 is thus understood to counter the force of the swager, and support the case base from deformation during this operation. The swager foot 78 may also be adapted for use during priming, where a primer is inserted into an empty pocket. A similar support function as provided by the swager foot 78 is understood to stabilize and align the cartridge case as the primer is being inserted.

The swager foot 78 may have a diameter that is substantially larger than that of the pin portion 72 of the decapping pin 68. In some embodiments as the one illustrated in FIG. 4, the swager foot 78 may be defined by a base portion 80 that is coupled to the ram shaft 76, with a reduced diameter anvil portion 82, with a taper 84 therebetween. Alternatively, the swager foot 78 may have a continuous diameter throughout its axial extent.

Aside from the above-described decapping pin 68 and the swager foot 78, the reloading die 10 may be adapted for other cartridge case tools 40 such as bullet seating stems and the like. As described above, the cartridge case tool 40 is attached or otherwise mounted to the retention cap 18, which in turn is mounted to the die body 12. Thus, a tip 86 of the cartridge case tool 40 is maintained at a proscribed distance relative to the first bore opening 30. In the case of the decapping pin 68 and the swager foot 78, the respective tips 86 thereof extend beyond the first bore opening 30 and at a set dimension from the outer lip 50 of the die body 12. In the case of a bullet seater (not shown), its tip may be within the body at a set distance from the first bore opening 30.

A portion of the cartridge case tool 40 includes threading 88 that is engageable to a corresponding threading 90 on the retention cap 18. Again, the retention cap 18 is defined by the first open end 20*a* and the opposed partially closed end 20*b*, and includes the body coupling portion 22 that is threaded onto the die body 12, as well as the central body 26. The retention cap 18, and specifically the central body 26 thereof, defines a cap bore 92 extending from the first open end 20*a*. The central body 26 has a base portion 94, which terminates the cap bore 92. Within the base portion is a threading hole 96 through which the cartridge case tool 40 is coupled to the retention cap 18.

Because the cartridge case tool 40 is threadably engaged to the retention cap 18, the cartridge case tool 40 can be variably positioned in relation thereto. The cartridge case tool 40 can be extended outwardly such that the tip 86 extends further out from the first bore opening 30 and the opposite shaft base end 98 is retracted into the retention cap 18, or vice versa. Thus, the aforementioned proscribed distance between the tip 86 of the cartridge case tool 40 and the first bore opening 30 is understood to be adjustable depending the threading depth of the cartridge case tool 40 into the retention cap 18. Further threaded onto the portion of the cartridge case tool 40 extending from the retention cap 18 may be the aforementioned tool locking nut 42 that is tightened against a distal end wall 100 of the retention cap 18.

The cap bore 92 is understood to have a diameter substantially corresponding to the diameter of the interior bore 28. As best shown in FIGS. 3 and 4, the biasing element 36 is disposed within the interior bore 28 and the cap bore 92, with the shuttle end 38*a* thereof abutting against the spring contact end 60 of the centering shuttle 34, and the retention cap end 38*b* abutting the base portion 94.

Figure 5A:
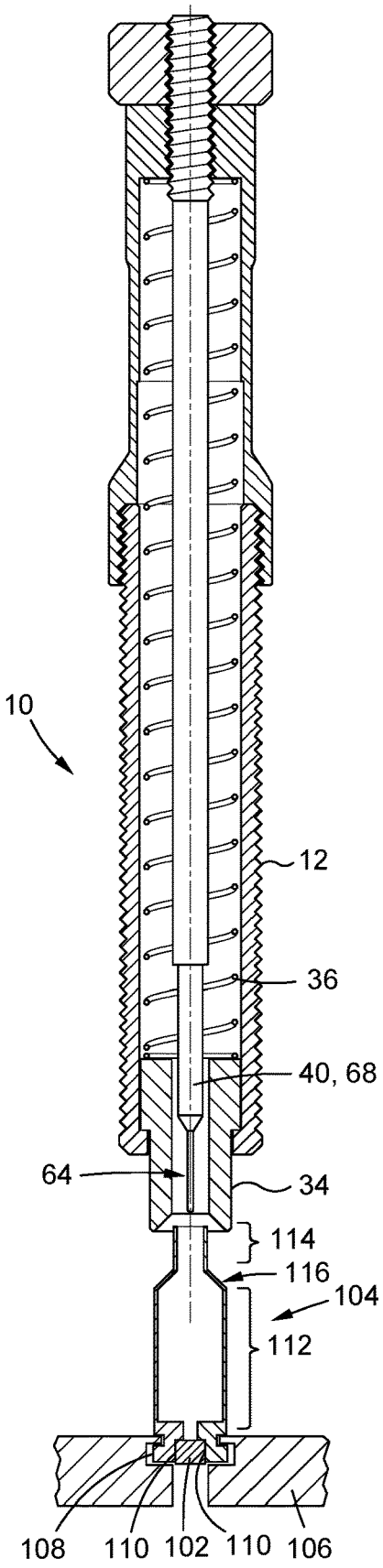
FIG. 5A-5C are cross-sectional views of the ammunition cartridge case reloading die over a typical decapping sequence with the cartridge case in different processing states.
Figure 5B:
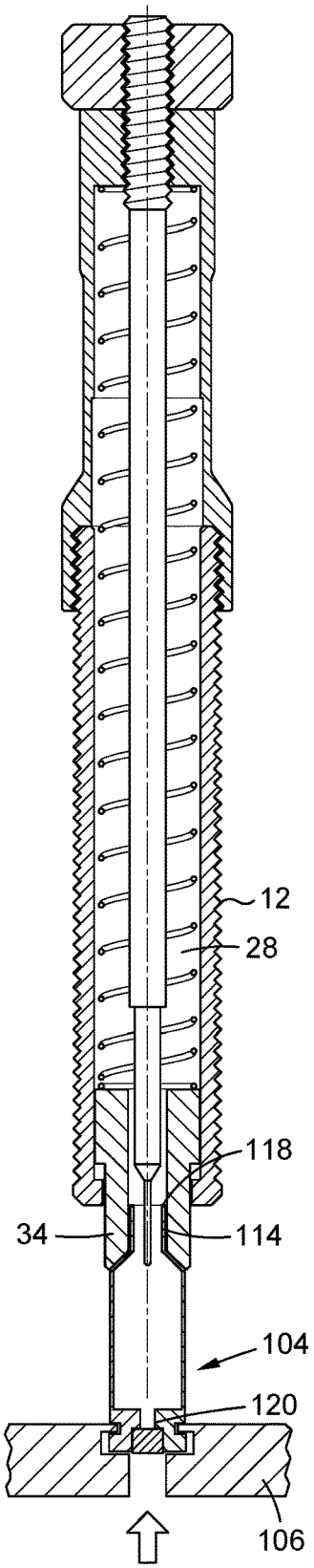
Figure 5C:
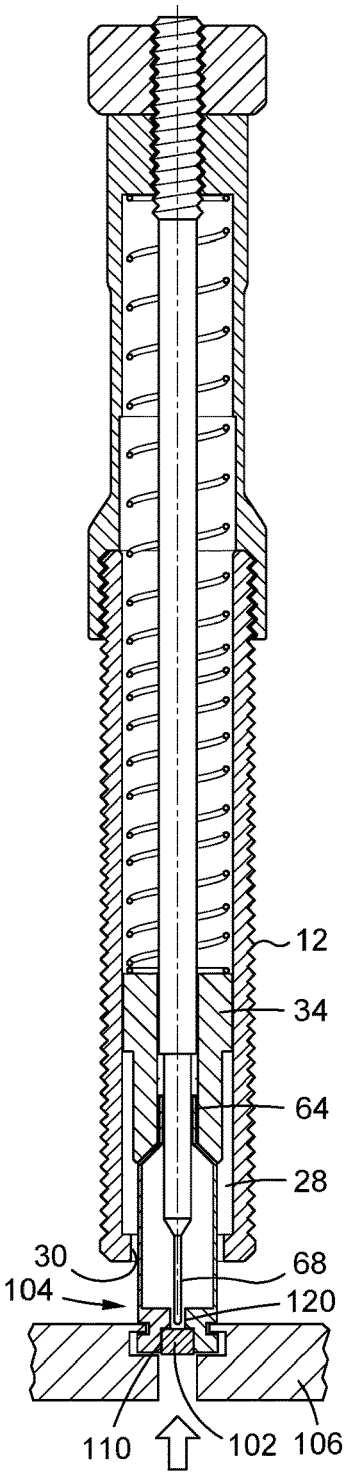

Referring now to FIGS. 5A-5C, an exemplary sequence of utilizing one embodiment of the reloading die 10 to remove the primer 102 from a cartridge case 104 will now be described. Initially, in the state illustrated in FIG. 5A, the cartridge case 104 positioned within a shell holder 106 that captures it by its rim 108. The spent primer 102 is held within a primer pocket 110 of the cartridge case 104. By way of example, the cartridge case 104 is a bottleneck type with a primary case wall 112, a neck 114, and a tapered shoulder 116 therebetween. The centering shuttle 34 is in its fully extended position relative to the die body 12 as a consequence of the spring force applied to the centering shuttle 34 toward the first bore opening 30 by the biasing element 36, and the cartridge case tool 40/decapping pin 68 remains sheathed within the centering shuttle 34 in the shuttle bore 64 thereof.

Next, as illustrated in FIG. 5B, the reloading press ram to which the shell holder 106 is attached is raised, also raising the shell holder 106 and the cartridge case 104 placed therein. The case mouth 118 of the cartridge case 104 may make contact with the centering shuttle 34 if there is any axial misalignment, though the tapered opening 66 thereof is understood to direct, channel, or otherwise funnel the neck 114 of the cartridge case 104 such that it fits within the shuttle bore 64. This is also understood to place the entirety of the cartridge case 104 in axial alignment with the cartridge case tool 40. To the extent the upward movement of the cartridge case 104 is not converted to the sliding movement of the case mouth 118 and begins moving the same toward the narrower shuttle bore 64, and the force being sufficient to overcome the spring bias, the centering shuttle 34 is moved upwardly into the interior bore 28 of the die body 12.

Once the cartridge case 104 is fully engaged within the centering shuttle 34, the entirety of the upward force applied by the reloading press ram is directed against the centering shuttle 34, driving the cartridge case 104 and the centering shuttle 34 into the interior bore 28 of the die body 12. By this point, the tip 86 of the cartridge case tool 40 is aligned with the center axis of the cartridge case 104, as well as the flash hole 120 between the primer pocket 110 and the cartridge case interior.

FIG. 5C illustrates the ram of the reloading press continuing to raise the shell holder 106, the cartridge case 104, and the centering shuttle 34 into the interior bore 28 of the die body 12. The decapping pin 68, which is stationary relative to the moving centering shuttle 34, enters the cartridge case 104 and the flash hole 120, eventually pressing against the primer 102 to remove the same from the primer pocket 110.

Once the primer 102 is removed, the reloading press ram may be lowered, also lowering the shell holder 106 and the cartridge case 104. Although the centering shuttle 34 is understood to return its maximum extension toward the first bore opening 30 due to the force exerted by the biasing element 36, the n108eck 114 may become dislodged from the shuttle bore 64 in the further downward stroke of the shell holder 106.

The particulars shown herein are by way of example only for purposes of illustrative discussion and are presented in the cause of providing what is believed to be the most useful and readily understood description of the principles and conceptual aspects of the various embodiments of the ammunition cartridge case reloading die set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An ammunition cartridge case reloading die comprising:

a die body defined by an interior bore and a bore opening;

a cartridge case tool mountable in axial alignment with the interior bore of the die body, a tip of the cartridge case tool being at a proscribed distance relative to the bore opening; and a centering shuttle in sliding engagement in the interior bore of the die body, the centering shuttle defining a shuttle bore through which the cartridge case tool passes and a tapered inner face at a tip end of the centering shuttle, the tapered inner face being engageable to the ammunition cartridge case while external to the die body and the centering shuttle is in full extension relative to the die body.

2. The reloading die of claim 1, wherein an exterior of the die body is threaded for mounting to a reloading press toolholder and receptive to a toolholder lock nut.

3. The reloading die of claim 1, wherein the cartridge case tool is defined by a base portion and a decapping pin, the decapping pin having a narrower diameter than the base portion.

4. The reloading die of claim 3, wherein the cartridge case tool is defined by a tapered neck portion between the base portion and the decapping pin.

5. The reloading die of claim 3, wherein the cartridge case tool includes a ram shaft, the base portion of the cartridge case tool being coupled to the ram shaft.

6. The reloading die of claim 1, wherein the cartridge case tool is a hold-down foot.

7. The reloading die of claim 6, wherein the hold-down foot is a swaging hold-down foot.

8. The reloading die of claim 1, wherein the cartridge case tool is a case expander.

9. The reloading die of claim 1, wherein the cartridge case tool has a unitary structure.

10. The reloading die of claim 9, further comprising a retention cap attachable to the die body.

11. The reloading die of claim 10, wherein the cartridge case tool is threadably mounted to the retention cap, the proscribed distance between the tip of the cartridge case tool and the bore opening being adjustable depending on the threading depth of the cartridge case tool into the retention cap.

12. The reloading die of claim 1, further comprising a tool locking nut threadable onto the cartridge case tool.

13. The reloading die of claim 1, further comprising:

a biasing element disposed within the interior bore against the centering shuttle, movement of the centering shuttle within the interior bore of the die body being dampened by the biasing element.

14. The reloading die of claim 13, wherein the die body includes an inner flange defining an inner rim face abutting against the shuttle shoulder, the centering shuttle being blocked from further movement beyond the bore opening, and the biasing element pressing the centering shuttle against the inner flange of the die body.

15. The reloading die of claim 1, wherein the centering shuttle is defined by a shuttle body with a diameter corresponding to a diameter of the interior bore of the die body, a shuttle neck having a diameter less than the shuttle body, and a shuttle shoulder.

16. The reloading die of claim 15, wherein the shuttle neck defines a tapered portion.

17. The reloading die of claim 16 wherein:

the cartridge case is bottlenecked and defined by a body, a neck narrower than the body, and a tapered shoulder between the body and the neck.

18. The reloading die of claim 17, wherein the shuttle bore has a diameter corresponding to an outer diameter of the neck of the cartridge case.

19. The reloading die of claim 17, wherein the reverse taper opening of the centering shuttle conforms to the tapered shoulder of the cartridge case.

20. A die for reloading an ammunition cartridge case, comprising:

a hollow die body with an open end receptive to the ammunition cartridge case;

a cartridge case tool centrally fixed relative to the die body, a tip of the cartridge case tool being positioned at a predefined distance to the open end of the die body; and a sliding shuttle within the hollow die body and in receptive engagement with the cartridge case tool, the sliding shuttle defining an inner face at a tip end thereof engageable to the ammunition cartridge case, the sliding shuttle being biased against the hollow die body, with inward movement thereof being dampened.

* * * * *